United States Patent [19]

Kötter

[11] Patent Number: 4,716,727

[45] Date of Patent: Jan. 5, 1988

[54] HYDRAULIC DEVICE

[75] Inventor: Wolfgang Kötter, Markgröningen, Fed. Rep. of Germany

[73] Assignee: Robert Bosch GmbH, Stuttgart, Fed. Rep. of Germany

[21] Appl. No.: 882,922

[22] PCT Filed: Nov. 28, 1985

[86] PCT No.: PCT/DE85/00419

§ 371 Date: Apr. 7, 1986

§ 102(e) Date: Apr. 7, 1986

[87] PCT Pub. No.: WO86/03264

PCT Pub. Date: Jun. 5, 1986

[30] Foreign Application Priority Data

Nov. 28, 1984 [DE] Fed. Rep. of Germany ..... 3443354

[51] Int. Cl.[4] ..... F15B 11/16

[52] U.S. Cl. ..... 60/423; 60/431

[58] Field of Search ..... 60/431, 423

[56] References Cited

U.S. PATENT DOCUMENTS

| | | | |
|---|---|---|---|
| 2,941,365 | 6/1960 | Carlson et al. | 60/431 X |
| 2,942,421 | 6/1960 | Moon et al. | 60/431 X |
| 3,214,901 | 11/1965 | Iverson | 60/431 |
| 3,866,418 | 2/1975 | Waters | 60/431 X |
| 3,987,625 | 10/1976 | Swatty et al. | 60/431 |
| 4,118,149 | 10/1978 | Hagberg | 60/431 X |
| 4,334,408 | 6/1982 | LePointe | 60/431 X |

FOREIGN PATENT DOCUMENTS

| | | |
|---|---|---|
| 8503744 | 8/1985 | PCT Int'l Appl. . |
| 2072260 | 2/1981 | United Kingdom . |

*Primary Examiner*—Alan Cohan

*Attorney, Agent, or Firm*—Michael J. Striker

[57] ABSTRACT

The hydraulic device is provided, by way of example, with a pump (10) being driven by a Diesel motor (13) feeding pressure medium through wayvalves (18 to 20) to consumers. The speed regulator (14) of the injection pump of the Diesel motor is influenced with the assistance of a pressure admitted set cylinder (15) on which the pressure generated in a control line (16) acts for the purpose of increasing the speed of the internal combustion engine. This pressure is controlled in cooperation of one of the wayvalves (18) for a single acting consumer and a pressure control valve (28) in such a manner that when actuating a customary wayvalve a constant pressure is generated in line (16). When actuating the other wayvalve (18) a specific control edge (48) becomes active generating an increasing pressure in line (16) being proportional for the deflection of the control slide. Thereby, the speed of the internal combustion engine and thereby the pump (10) is increased and is so adjusted that the consumers receive only the required amount of pressure medium. In this manner an economical operation is possible.

5 Claims, 3 Drawing Figures

HYDRAULIC DEVICE

STATE OF THE ART

Figure 1:
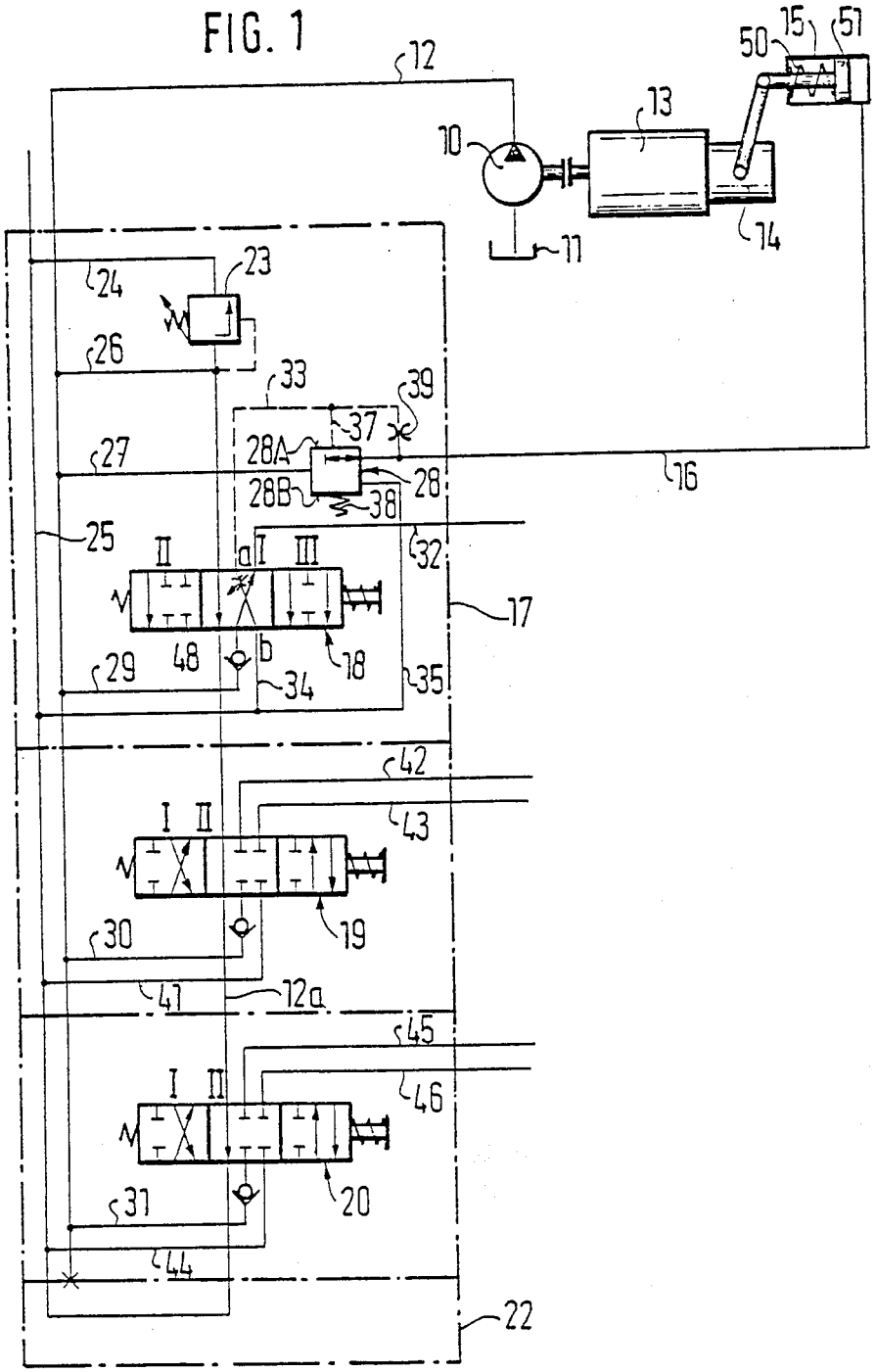

The invention is based on a hydraulic device in accordance with the type of the main claim. In order to economically operate hydraulic devices it is known to set the pump in such a manner that it provides the pressure and the feeding flow required by the consumer. For this purpose the load pressure being present in the consumer is fed to a flow control valve which, for example, controls a setting means for the pump in such a manner that the aforementioned requirement is met. Such known devices and equipments are expansive, on the one hand, since a variable pump must be used, or they do not operate at an economic optimum.

In order to simplify such devices it had been already suggested to control the speed of the pump in such a manner that it meets the aforementioned requirements. For this purpose a pressure control valve is provided which generates a control pressure adjusting a variable cylinder for a speed regulator of an internal combustion engine driving the pump. However, difficulties were encountered with respect to the oscillation characteristics of the pressure control valve and therefore with respect to the control of the speed regulator. This resulted in that a practical operation of such a device could not be performed.

ADVANTAGES OF THE INVENTION

In contrast thereto, the hydraulic device in accordance with the invention and with the characterizing features of the main claim is advantageous in that it is designed relatively simple permitting a use without any problems and in a very economical manner.

Further embodiments and improvements of the features stated in the main claim are possible by the measures stated in the subclaims.

DRAWING

Two exemplified embodiments of the invention are illustrated in the drawing and are explained in detail in the subsequent description. The drawings illustrate in FIGS. 1 and 2 hydraulic devices in a schematic illustration, FIG. 3 a diagram

DESCRIPTION OF THE EXEMPLIFIED EMBODIMENT

A non-variable pump is designated with 10 in FIG. 1, which draws in a pressure medium from a container 11 and displaces it into a feed line 12. Pump 10 is driven by an internal combustion engine 13, in particular a Diesel engine, whose member 14 determining the fuel supply, in a Diesel motor the injection pump or the speed regulator thereof, is set by means of an hydraulically admitted set cylinder 15. The same is admitted with pressure medium through a line 16 which leads to a valve control block 17. In the same three wayvalves 18 to 20 are successively disposed, whereby the wayvalve 18 controls a simgle acting consumer, however the wayvalves 19,20 double acting consumers.

The feed line 12 also leads to the control block 17. A neutral circulating line 12A is connected thereto which starts from an end plate 22 closing the control block and ends on a pressure limiting valve 23. From there a line 24 extends to a return flow line 25 which also extends through the control block 17. A line 26 branches from feed line 12 in control block 17 extending to the pressure limiting valve, furthermore a line 27 extending to a pressure control valve 28, a line 29 extending to wayvalve 18, a line 30 extending to wayvalve 19 and a line 31 extending to wayvalve 20. A first line 32 extends from wayvalve 18 to a nonillustrated single acting consumer, a second line 33 to line 16 and a line 34 to a line 35 which extends from the return flow line to the discharge side of the pressure control valve 28. A line 37 branches from line 38 extending to the one front face 28A of the pressure control valve 28, whereby a control spring acts on the opposite front face 28B. A throttle 39 is disposed in line 33 in the proximity of the discharge into line 16. The pressure control valve 28 provides a connection, dependent on its position, either to line 16 by means of line 27 being connected with feed line 12 or to line 35 which is connected with the return line 25. The pressure control valve 28 is controlled by the liquid pressure acting to its front face 28 A against the force of spring 38.

The wayvalve 18 can assume three switch positions I, II and III, whereby position II is the closed position, position I the operating position and position III is the relieve position. This wayvalve is designed as a 6/3-wayvalve and represents in its position I the connection from line 29 to line 32 and thereby to the consumer, on the one hand, and from line 34 to line 33 and thereby to line 16, on the other hand.

A line 41 extends from the wayvalve 19 to the return line 25 and two lines 42,43 to a nonillustrated double acting consumer. This is similar with respect to wayvalve 20;here a line 44 extends to the return line 25 and two lines 45,46 also to a double acting consumer. The wayvalves 19,20 are also designed as 6/3-wayvalves and have the same switching positions I to III as wayvalve 18. However, this differs from the wayvalves 19,20 that one each adjustable throttle 48 is provided in operating position I between the connections a and b, e.i., between the lines 33 and 34. In reality, this represents, as is already known, a control groove on the control slide edge which opens wider and wider with increasing displacement of the control slide, so the throughflow cross section from line 33 to line 34 is increasingly opened.

When all wayvalves are in the neutral position II, the pressure medium being fed by the pump 10 flows from line 12 through line 26 and into the neutral circulating line **12*a* and from there into the return flow line 25*a* to the container. Thereby, a low neutral circulating pressure of, for example, 3 bar prevails in lines 12, 12*a*, 27 and 16, whereby the latter lines are connected with each other by the pressure control valve 28. Spring 50 in the set cylinder 25 displaces the piston 51 to the right and thereby sets the speed regulator 13 to idling speed. This means that the speed of the pump is now low and generates, as already stated above, only the low circulating pressure which is designated as $P_1$ in the diagram of FIG. 3. On the abscissa in this diagram the stroke of the control slide of the wayvalve 18 is illustrated and on the ordinate the speed of the internal combustion engine 13 or the control pressure in line 16**.

When one of the wayvalves 19 or 20 is adjusted into operating position I, then the connection from line 26 to the neutral circulating line **12*a* is interrupted, the pressure in line 27 increases and thereby also in line 16, in the latter up to a pressure $P_2$ of, for example, 6 bar. This pressure corresponds to the regulator spring 38. During a further increase in pressure in line 27 the pressure in line 16 remains constant, since it is maintained in this value by the pressure control valve 28. Now, pressure medium flow from line 12 through one of lines 42 or 45 of the wayvalve 19 or 20 to the consumer. Due to the increased pressure in line 16 the piston 51 of the set cylinder 15 is displaced against the spring force, whereby the speed regulator 14 sets the internal combustion engine 13 to a higher speed. Thereby, the feeding pressure and the amount fed by pump 10 increase. It should also be mentioned that from the consumers which are connected to wayvalves 19,20 pressure medium flows through line 43 or 46** to the container.

When the wayvalve 18 is displaced from its neutral position II in the direction to the operating position I, either alone or during a simultaneous actuation of one of the vlaves 19,20 the pressure medium flows through line 32 and to the consumer, on the one hand, and from the pressure face 28A of the pressure control valve 28 through line 37 and line 33 as well as the wayvalve 18 and the line 34 increasingly to the return flow line 25, on the other hand. This flow is limited by throttle 48 in the wayvalve 18. Simultaneously, pressure medium also flows from line 16 through throttle 39 in a limited amount into line 33, whereby the pressure on the pressure face 28 A of the pressure control valve is lowered, whereupon the control spring 38 increasingly makes a connection from line 27 to line 26. Thus, the pressure increases in line 16, so that the speed regulator 14 permits the internal combustion engine to increase to a still higher speed. The speed becomes higher, the further the wayvalve 18 is adjusted in its operating position I. Therefore,the speed of the internal combustion engine 13 also increases proportional to the deflection of the wayvalve 18. This can be recognized by the ascending curve $P_3$ in the diagram of FIG.3. When returning the wayvalve 18 from its switch position I to II the pressure in line 16 again is lowering,so that the speed of the internal combustion engine is reduced.

Figure 2:
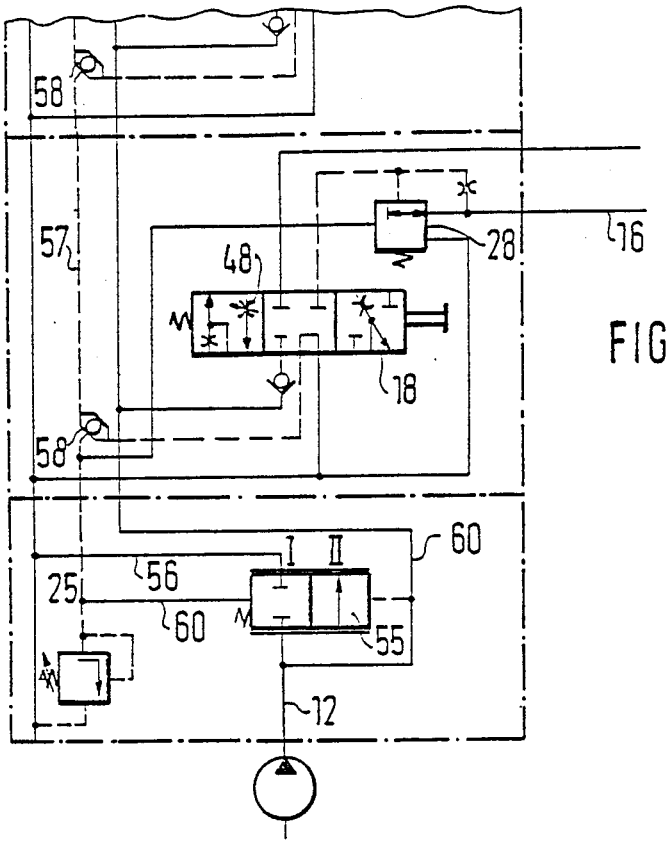
Figure 3:
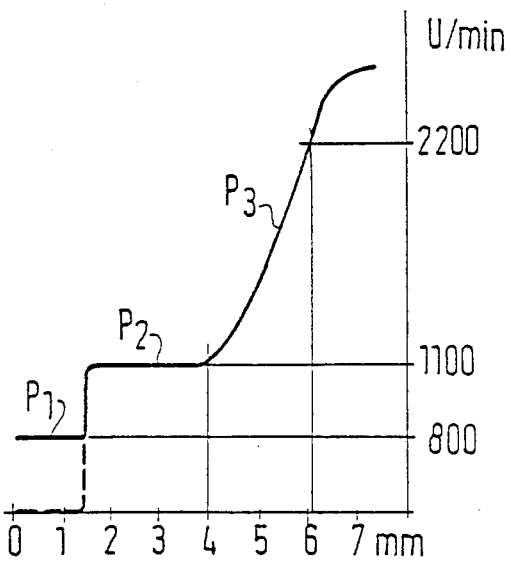

The exemplified embodiment in accordance with FIG. 2 differs with respect to the one of FIG. 1 essentially in that it is a so-called load-sensing-hydraulic circuit which is provided with a flow control valve 55 which is connected to the feeding line 12 and which has a connecting line 56 to the return line 25. Moreover, a control line 57 is provided in the control block, whereby an alternating nonreturn valve 58 is provided for each wayvalve. Essentially, the wayvalves correspond to the aforedescribed wayvalves, however with the difference that always a connecting line to the alternating nonreturn valve 58 exists. The highest prevailing pressure on a consumer is selected by these alternating nonreturn valves and fed through a line 60 to the flow regulating valve 55. Such arrangements are known per se and have the purpose to adjust the flow control valve 55 in the neutral position of the wayvalves in such a manner that it provides a direct connection from the pump to the return flow line in its switch position II, so that no power loss is generated. The supply pressure of the pressure controll valve 28 comes from control line 60 for the flow control valve 55, e.i., in the neutral position of the wayvalve 18 the pressure is lowered in the set cylinder 15 or in the line 16 to a container pressure, see the dotted line in FIG. 3.

I claim:

1. A hydraulic device, comprising a pump (10); a motor (13) arranged to drive said pump; a regulator (14) arranged to set a speed of said motor; a pressure medium actuated adjusting cylinder-piston unit (15) arranged to adjust said regulator (14); a line (16) through which said adjusting cylinder-piston unit adjusts said regulator; a plurality of wayvalves (18, 19, 20) through which a plurality of consumers are supplied by said pump (10), said adjusting cylinder-piston unit being arranged to adjust said regulator (14) so that a speed of said motor (13) and thereby an amount fed by said pump (10) is just as large as required by the consumers which are supplied by said pump (10) through said wayvalves (18, 19, 20); and a pressure control valve (28) which generates a pressure in said line (16), said pressure control valve being formed so that during actuating a customary one of said wayvalves (19, 20) for one consumer said pressure control valve (28) generates a constant pressure, and during actuating of a particular one of said wayvalves (18) for another consumer, the particular wayvalve (18) provided with an adjustable throttle edge (48), said pressure control valve (28) generates an increasing pressure which is proportional to a slide deflection.

2. A hydraulic device as defined in claim 1, wherein said throttle edge (48) of said particular wayvalve (18) is formed as a fine control chamfer.

3. A hydraulic device as defined in claim 1; and further comprising a return flow line (15), said particular wayvalve (18) being formed for controlling the other consumer which is a single acting consumer, said particular wayvalve (18) having an operating position in which it controls a communication from said line (16) to said return flow line (25).

4. A hydraulic device as defined in claim 2; and further comprising a return flow line (15), said particular wayvalve (18) being formed for controlling the other consumer which is a single acting consumer, said particular wayvalve (18) having an operating position in which it controls a communication from said line (16) to said return flow line (25).

5. A hydraulic device as defined in claim 1, wherein said pressure control valve (28) is integrated in said particular wayvalve (18).

* * * * *